US009194106B2

(12) United States Patent
Matsuyama

(10) Patent No.: US 9,194,106 B2
(45) Date of Patent: Nov. 24, 2015

(54) WORKING UNIT CONTROL SYSTEM, CONSTRUCTION MACHINE AND WORKING UNIT CONTROL METHOD

(75) Inventor: Toru Matsuyama, Kanagawa (JP)

(73) Assignee: KOMATSU LTD., Tokyo (JP)

( * ) Notice: Subject to any disclaimer, the term of this patent is extended or adjusted under 35 U.S.C. 154(b) by 10 days.

(21) Appl. No.: 13/983,328

(22) PCT Filed: Feb. 7, 2012

(86) PCT No.: PCT/JP2012/052685
§ 371 (c)(1),
(2), (4) Date: Aug. 2, 2013

(87) PCT Pub. No.: WO2012/127912
PCT Pub. Date: Sep. 27, 2012

(65) Prior Publication Data

US 2014/0142817 A1 May 22, 2014

(30) Foreign Application Priority Data

Mar. 24, 2011 (JP) ..... 2011-066824

(51) Int. Cl.
*E02F 9/20* (2006.01)
*E02F 3/43* (2006.01)

(52) U.S. Cl.
CPC ..... *E02F 9/2025* (2013.01); *E02F 3/435* (2013.01); *E02F 3/437* (2013.01); *E02F 3/439* (2013.01)

(58) Field of Classification Search
CPC ..... E02F 3/439; E02F 3/404; E02F 3/435
USPC ..... 701/50; 414/687, 730
See application file for complete search history.

(56) References Cited

U.S. PATENT DOCUMENTS 5,528,843 A * 6/1996 Rocke ..... 37/348
5,682,312 A * 10/1997 Rocke ..... 701/50

(Continued)

FOREIGN PATENT DOCUMENTS

CN 1140782 A 1/1997
CN 1153248 A 7/1997

(Continued)

OTHER PUBLICATIONS

The Office Action for the corresponding Chinese application No. 201280008286.7, issued on Sep. 28, 2014.

(Continued)

*Primary Examiner* — Thomas G Black
*Assistant Examiner* — Wae Louie
(74) *Attorney, Agent, or Firm* — Global IP Counselors, LLP

(57) ABSTRACT

A working unit control system includes a working unit, an operating tool, a work type determining part, and a drive controlling part. The operating tool is configured to receive a user operation to drive the working unit, and to output an operation signal in accordance with the user operation. The work type determining part is configured to determine to which of a shaping work and a cutting edge aligning work a work type of the working unit corresponds based on the operation signals. The drive controlling part configured to move the bucket along a designed surface when the work type corresponds to the shaping work, the drive controlling art being configured in a predetermined position set with reference to the designed surface when the work type corresponds to the cutting edge aligning work, the designed surface indicating a target shape of an excavation object.

7 Claims, 8 Drawing Sheets

(56) References Cited

U.S. PATENT DOCUMENTS

| | | | | |
|---|---|---|---|---|
| 5,735,065 | A * | 4/1998 | Yamagata et al. | 37/348 |
| 5,799,419 | A * | 9/1998 | Seo et al. | 37/348 |
| 8,204,655 | B2 * | 6/2012 | Tomita et al. | 701/50 |
| 2008/0097673 | A1 * | 4/2008 | Tomita et al. | 701/50 |
| 2011/0033274 | A1 * | 2/2011 | Tomita et al. | 414/730 |
| 2013/0287601 | A1 * | 10/2013 | Mori et al. | 417/364 |
| 2013/0302124 | A1 * | 11/2013 | Matsuyama | 414/687 |
| 2013/0315699 | A1 * | 11/2013 | Matsuyama | 414/687 |
| 2014/0142817 | A1 * | 5/2014 | Matsuyama | 701/50 |
| 2014/0200776 | A1 * | 7/2014 | Matsuyama et al. | 701/50 |

FOREIGN PATENT DOCUMENTS

| | | | |
|---|---|---|---|
| DE | 38 55 618 | T2 | 5/1997 |
| EP | 0 512 584 | A2 | 11/1992 |
| EP | 0 707 118 | A1 | 4/1996 |
| JP | 62-206127 | A | 9/1987 |
| JP | 7-259117 | A | 10/1995 |
| JP | 2007-85093 | A | 4/2007 |
| JP | 2009-179968 | A | 8/2009 |
| WO | 95/30059 | A1 | 11/1995 |

OTHER PUBLICATIONS

International Search Report for PCT/JP2012/052685, issued on May 15, 2012.

The Office Action for the corresponding German application No. 11 2012 000 540.6, issued on Sep. 11, 2015.

* cited by examiner

WORKING UNIT CONTROL SYSTEM, CONSTRUCTION MACHINE AND WORKING UNIT CONTROL METHOD

CROSS-REFERENCE TO RELATED APPLICATIONS

This application claims priority to Japanese Patent Application No. 2011-066824, filed on Mar. 24, 2011, the disclosure of which is hereby incorporated herein by reference in its entirety.

BACKGROUND

1. Field of Invention

The present invention relates to a working unit control system including a working unit and a construction machine including the working unit control system.

2. Background Information

For a construction machine equipped with a working unit, a method has been conventionally known that a predetermined region is excavated by moving a bucket along a designed surface indicating a target shape for an excavation object (see PCT International Publication No. WO95/30059).

Specifically, a control device in PCT International Publication No. WO95/30059 is configured to correct an operation signal to be inputted by an operator for operating the bucket so that the relative speed of the bucket with respect to the designed surface is reduced as an interval is reduced between the bucket and the designed surface. Thus, the bucket is automatically moved along the designed surface by imposing a limitation on the speed of the bucket.

SUMMARY

However, in PCT International Publication No. WO95/30059, even when an operator tries to stop the cutting edge of the bucket in a position proximal to the designed surface, the bucket is inevitably automatically moved along the designed surface regardless of such operation by the operator. Therefore, speed limitation is required to be terminated for setting the cutting edge in a predetermined position. Further, while speed limitation is being terminated, the operator is required to manually set the cutting edge in the predetermined position.

In view of the above, it has been demanded to automatically switch between a shaping mode of moving the bucket along the designed surface and a cutting edge aligning mode of stopping the cutting edge in a predetermined position even during execution of speed limitation.

The present invention has been produced in view of the aforementioned situation, and is intended to provide a working unit control system capable of automatically switching between a shaping mode and a cutting edge aligning mode, a construction machine and a working unit control method.

An excavation control system according to a first aspect includes a working unit, an operating tool, a work type determining part and a drive controlling part. The working unit is formed by a plurality of driven members including a bucket, and is rotatably supported by a vehicle main body. The operating tool is configured to: receive a user operation to drive the working unit; and output an operation signal in accordance with the user operation. The work type determining part is configured to determine to which of a shaping work and a cutting edge aligning work a work type of the working unit corresponds based on the aforementioned an operation signal. The drive controlling part is configured to: move the bucket along a designed surface indicating a target shape of an excavation object when it is determined that the work type corresponds to the shaping work; and stop the bucket in a predetermined position set with reference to the designed surface when it is determined that the work type corresponds to the cutting edge aligning work.

A working unit control system according to a second aspect includes a working unit, an inside pressure obtaining part, a work type determining part and a drive controlling part. The working unit is formed by a plurality of driven members including a bucket, and is rotatably supported by a vehicle main body. The inside pressure obtaining part is configured to obtain an inside pressure of a hydraulic cylinder for driving the working unit. The work type determining part is configured to determine to which of a shaping work and a cutting edge aligning work a work type of the working unit corresponds based on the inside pressure. The drive controlling part is configured to: move the bucket along a designed surface indicating a target shape of an excavation object when it is determined that the work type corresponds to the shaping work; and stop the bucket in a predetermined position set with reference to the designed surface when it is determined that the work type corresponds to the cutting edge aligning work.

A working unit control system according to a third aspect includes a working unit, a discharge pressure obtaining part, a work type determining part and a drive controlling part. The working unit is formed by a plurality of driven members including a bucket, and is rotatably supported by a vehicle main body. The discharge pressure obtaining part is configured to obtain a discharge pressure of a hydraulic pump for supplying an operating oil to a plurality of hydraulic cylinders for driving the plurality of driven members on a one-to-one basis. The work type determining part is configured to determine to which of a shaping work and a cutting edge aligning work a work type of the working unit corresponds based on the discharge pressure. The drive controlling part is configured to: move the bucket along a designed surface indicating a target shape of an excavation object when it is determined that the work type corresponds to the shaping work; and stop the bucket in a predetermined position set with reference to the designed surface when it is determined that the work type corresponds to the cutting edge aligning work.

A working unit control method includes the steps of: receiving a user operation to drive a working unit, which is formed by a plurality of driven members including a bucket and is rotatably supported by a vehicle main body, and outputting an operation signal in accordance with the user operation; determining to which of a shaping work and a cutting edge aligning work a work type of the working unit corresponds based on the operation signal; stopping the bucket in a predetermined position set with reference to the designed surface when it is determined that the work type corresponds to the cutting edge aligning work; and moving the bucket along the designed surface indicating a target shape of an excavation object when a type of the user operation is received to drive a predetermined one of the plurality of driven members after the bucket is stopped in the predetermined position.

It is possible to provide a working unit control system capable of automatically switching between a shaping mode and a cutting edge aligning mode, a construction machine and a working unit control method.

DESCRIPTION OF EMBODIMENTS

Explanation will be hereinafter made for an exemplary embodiment of the present invention with reference to the drawings. In the following explanation, a hydraulic excavator will be explained as an example of "construction machine".

Overall Structure of Hydraulic Excavator 100

Figure 1:
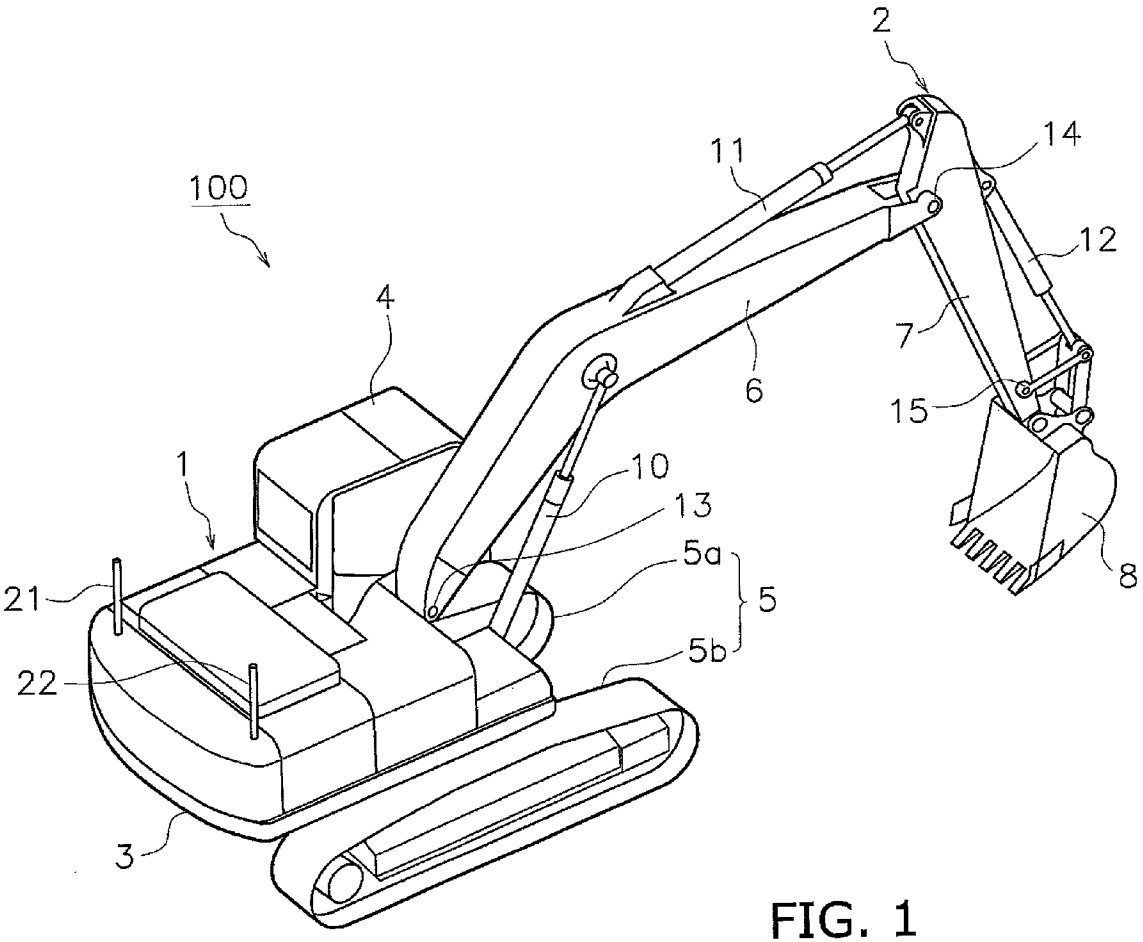
FIG. 1 is a perspective view of a hydraulic excavator 100.

FIG. 1 is a perspective view of a hydraulic excavator 100 according to an exemplary embodiment. The hydraulic excavator 100 includes a vehicle main body 1 and a working unit 2. Further, the hydraulic excavator 100 is embedded with an excavation control system 200. Explanation will be made below for a configuration and an action of the excavation control system 200.

The vehicle main body 1 includes an upper revolving unit 3, a cab 4 and a drive unit 5. The upper revolving unit 3 accommodates an engine, a hydraulic pump and so forth (not illustrated in the figures). A first GNSS antenna 21 and a second GNSS antenna 22 are disposed on the rear end part of the upper revolving unit 3. The first GNSS antenna 21 and the second GNSS antenna 22 are antennas for RTK-GNSS (Real Time Kinematic—GNSS, note GNSS refers to Global Navigation Satellite Systems). The cab 4 is mounted on the front part of the upper revolving unit 3. An operating device 25 to be described is disposed within the cab 4 (see FIG. 3). The drive unit 5 includes crawler belts 5*a* and 5*b*, and circulation of the crawler belts 5*a* and 5*b* enables the hydraulic excavator 100 to travel.

The working unit 2 is attached to the front part of the vehicle main body 1, and includes a boom 6, an arm 7, a bucket 8, a boom cylinder 10, an arm cylinder 11 and a bucket cylinder 12. The base end of the boom 6 is pivotally attached to the front part of the vehicle main body 1 through a boom pin 13. The base end of the arm 7 is pivotally attached to the tip end of the boom 6 through an arm pin 14. The bucket 8 is pivotally attached to the tip end of the arm 7 through a bucket pin 15.

The boom cylinder 10, the arm cylinder 11 and the bucket cylinder 12 are respectively hydraulic cylinders to be driven by means of an operating oil. The boom cylinder 10 is configured to drive the boom 6. The arm cylinder 11 is configured to drive the aim 7. The bucket cylinder 12 is configured to drive the bucket 8.

Figure 2A:
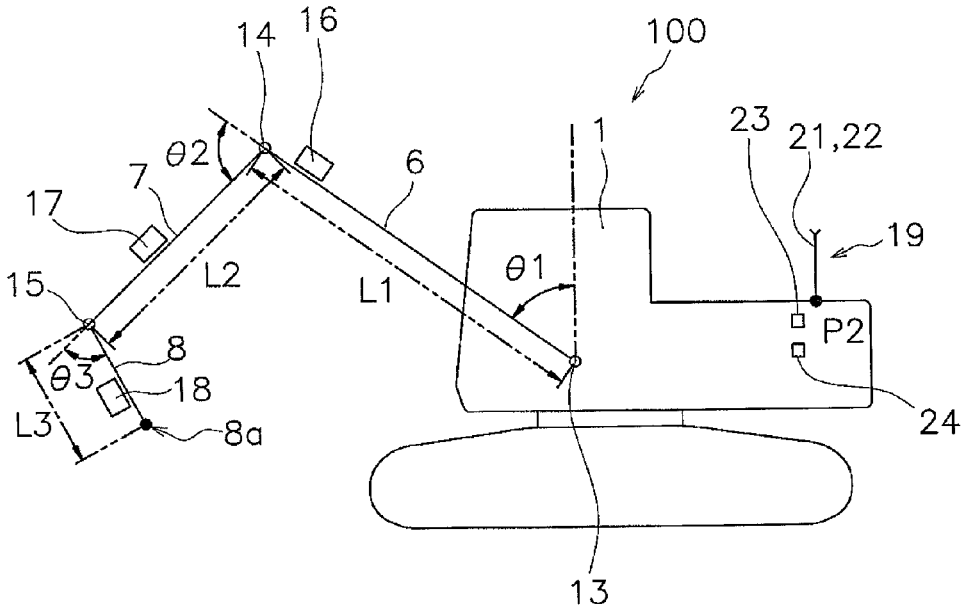
FIG. 2A is a side view of the hydraulic excavator 100.
Figure 2B:
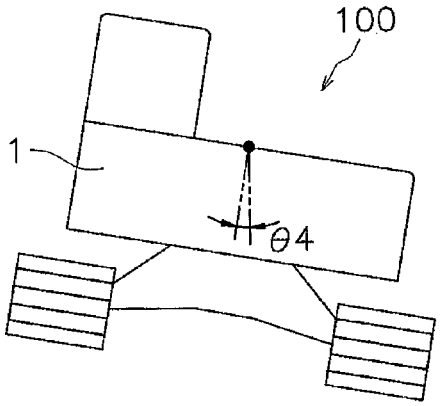
FIG. 2B is a rear view of the hydraulic excavator 100.

Now, FIG. 2A is a side view of the hydraulic excavator 100, whereas FIG. 2B is a rear view of the hydraulic excavator 100. As illustrated in FIG. 2A, the length of the boom 6, i.e., the length from the boom pin 13 to the arm pin 14 is L1. The length of the arm 7, i.e., the length from the arm pin 14 to the bucket pin 15 is L2. The length of the bucket 8, i.e., the length from the bucket pin 15 to the tip ends of teeth of the bucket 8 (hereinafter referred to as "a cutting edge 8*a*" as an example of "a first monitoring point") is L3*a*. Further, the length from the bucket pin 15 to the rear surface side outermost end of the bucket 8 (hereinafter referred to as "a rear surface end 8*b*" as an example of "a second monitoring point") is L3*b*.

Further, as illustrated in FIG. 2A, the boom 6, the arm 7 and the bucket 8 are provided with first to third stroke sensors 16 to 18 on a one-to-one basis. The first stroke sensor 16 is configured to detect the stroke length of the boom cylinder 10 (hereinafter referred to as "a boom cylinder length N1"). Based on the boom cylinder length N1 detected by the first stroke sensor 16, a display controller 28 to be described (see FIG. 3) is configured to calculate a slant angle θ1 of the boom 6 relative to the vertical direction in the Cartesian coordinate system of the vehicle main body. The second stroke sensor 17 is configured to detect the stroke length of the arm cylinder 11 (hereinafter referred to as "an arm cylinder length N2"). Based on the arm cylinder length N2 detected by the second stroke sensor 17, the display controller 28 is configured to calculate a slant angle θ2 of the arm 7 with respect to the boom 6. The third stroke sensor 18 is configured to detect the stroke length of the bucket cylinder 12 (hereinafter referred to as "a bucket cylinder length N3"). Based on the bucket cylinder length N3 detected by the third stroke sensor 18, the display controller 28 is configured to calculate a slant angle θ3*a* of the cutting edge 8*a* with respect to the arm 7 and a slant angle θ3*b* of the rear surface end 8*b* with respect to the arm 7.

The vehicle main body 1 is equipped with a position detecting unit 19. The position detecting unit 19 is configured to detect the present position of the hydraulic excavator 100. The position detecting unit 19 includes the aforementioned first and second GNSS antennas 21 and 22, a three-dimensional position sensor 23 and a slant angle sensor 24. The first and second GNSS antennas 21 and 22 are disposed while being separated at a predetermined distance in the vehicle width direction. Signals in accordance with GNSS radio waves received by the first and second GNSS antennas 21 and 22 are configured to be inputted into the three-dimensional position sensor 23. The three-dimensional position sensor 23 is configured to detect the installation positions of the first and second GNSS antennas 21 and 22. As illustrated in FIG. 2B, the slant angle sensor 24 is configured to detect a slant angle θ4 of the vehicle main body 1 in the vehicle width direction with respect to a gravity direction (a vertical line).

Configuration of Excavation Control System 200

Figure 3:
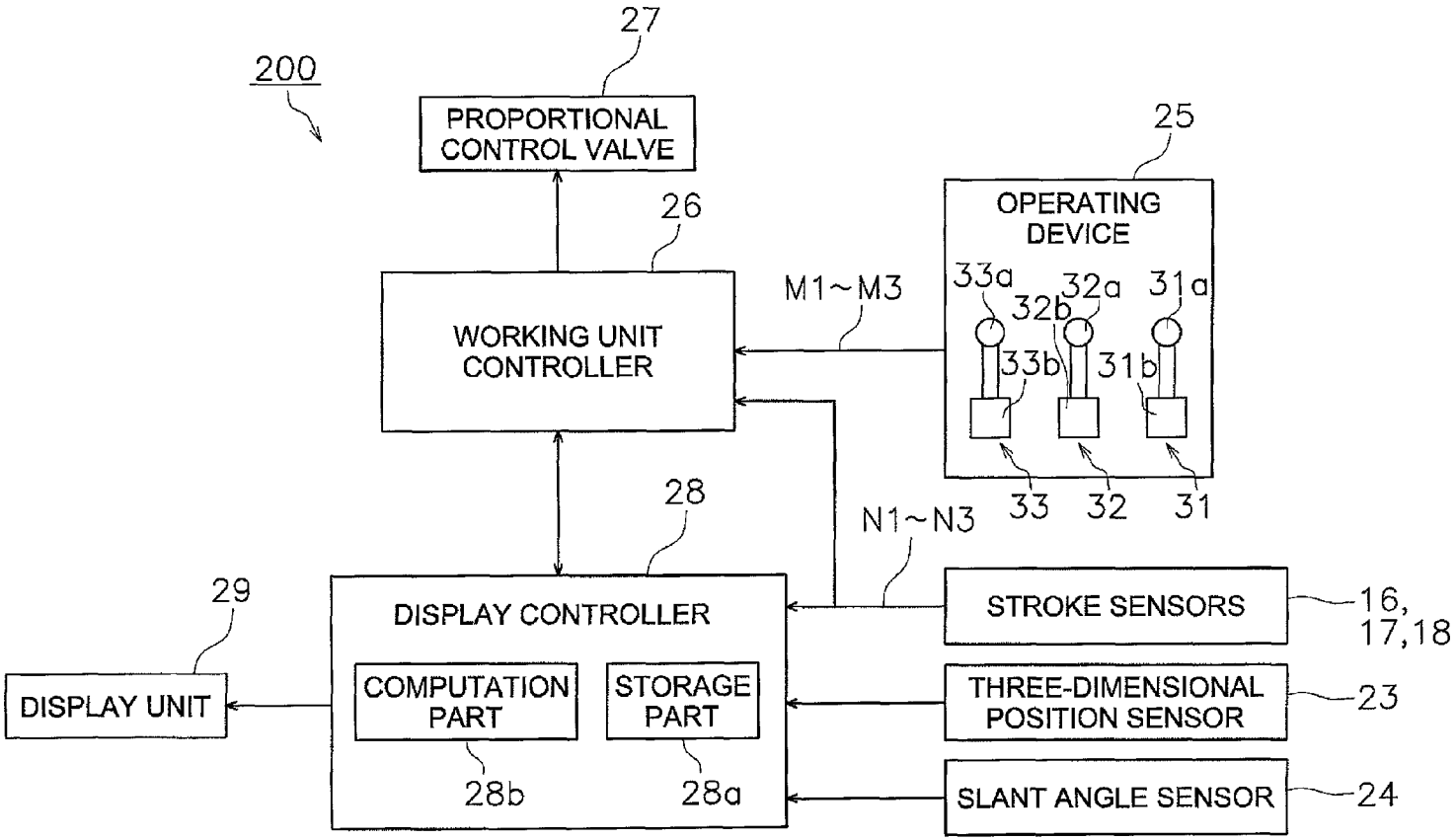
FIG. 3 is a block diagram representing a functional configuration of an excavation control system 200.

FIG. 3 is a block diagram representing a functional configuration of the excavation control system 200. The excavation control system 200 includes the operating device 25, a working unit controller 26, a proportional control valve 27, the display controller 28 and a display unit 29.

The operating device 25 is configured to receive an operation by an operator to drive the working unit 2 and is configured to output an operation signal in accordance with the operation of the operator. Specifically, the operating device 25 includes a boom operating tool 31, an arm operating tool 32 and a bucket operating tool 33. The boom operating tool 31 includes a boom operating lever 31*a* and a boom operation detecting part 31*b*. The boom operating lever 31*a* receives an operation of the boom 6 by the operator. The boom operation detecting part 31*a* is configured to output a boom operation signal M1 in response to an operation of the boom operating lever 31*a*. An arm operating lever 32*a* receives an operation of the arm 7 by the operator. An arm operation detecting part 32*b* is configured to output an arm operation signal M2 in response to an operation of the arm operating lever 32*a*. The bucket operating tool 33 includes a bucket operating lever 33*a* and a bucket operation detecting part 33*b*. The bucket operating lever 33*a* receives an operation of the bucket 8 by the operator. The bucket operation detecting part 33*b* is configured to output a bucket operation signal M3 in response to an operation of the bucket operating lever 33*a*.

The working unit controller 26 is configured to obtain the boom operation signal M1, the arm operation signal M2 and the bucket operation signal M3 (hereinafter referred to as "operation signals M' on an as-needed basis") from the operating device 25. The working unit controller 26 is configured to obtain the boom cylinder length N1, the arm cylinder length N2 and the bucket cylinder length N3 from the first to third stroke sensors 16 to 18, respectively. The working unit controller 26 is configured to output control signals based on the aforementioned various pieces of information to the proportional control valve 27. Accordingly, the working unit controller 26 is configured to execute an excavation control of automatically moving the bucket 8 along designed surfaces 45 (see FIG. 4). At this time, as described below, the working unit controller 26 is configured to correct the boom operation signal M1 and then output the corrected boom operation signal M1 to the proportional control valve 27. On the other hand, the working unit controller 26 is configured to output the arm operation signal M2 and the bucket operation signal M3 to the proportional control valve 27 without correcting the signals M2 and M3. A function and an action of the working unit controller 26 will be described below.

The proportional control valve 27 is disposed among the boom cylinder 10, the arm cylinder 11, the bucket cylinder 12 and a hydraulic pump (not illustrated in the figures). The proportional control valve 27 is configured to supply the operating oil at a flow rate set in accordance with the control signal from the working unit controller 26 to each of the boom cylinder 10, the arm cylinder 11 and the bucket cylinder 12.

The display controller 28 includes a storage part 28*a* (e.g., a RAM, a ROM, etc.) and a computation part 28*b* (e.g., a CPU, etc.). The storage part 28*a* stores a set of working unit data that contains the aforementioned lengths, i.e., the length L1 of the boom 6, the length L2 of the arm 7 and the lengths L3*a* and L3*b* of the bucket 8. The set of working unit data contains the minimum value and the maximum value for each of the slant angle θ1 of the boom 6, the slant angle θ2 of the arm 7, the slant angle θ3*a* of the cutting edge 8*a* and the slant angle θ3*b* of the rear surface end 8*b*. The display controller 28 can be communicated with the working unit controller 26 by means of wireless or wired communication means. The storage part 28*a* of the display controller 28 has preliminarily stored a set of designed landform data indicating the shape and the position of a three-dimensional designed landform within a work area. The display controller 28 is configured to cause the display unit 29 to display the designed landform based on the designed landform, detection results from the aforementioned various sensors, and so forth.

Figure 4:
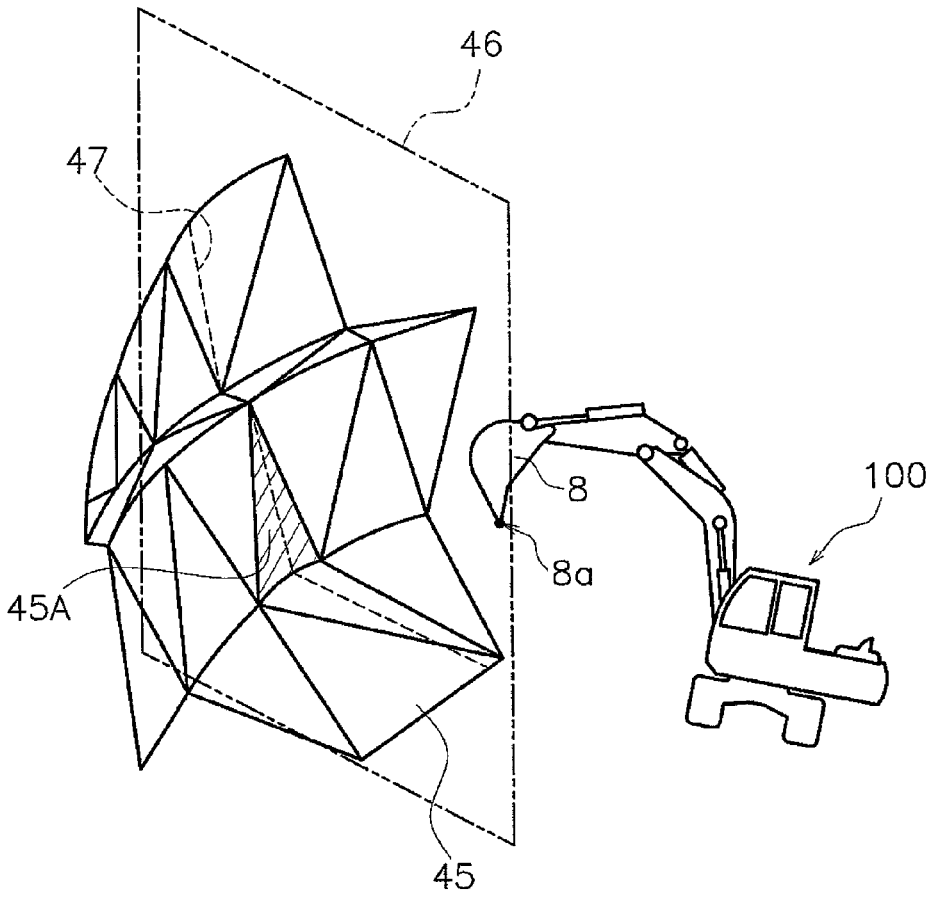
FIG. 4 is a schematic diagram illustrating an exemplary designed landform to be displayed on a display unit 29.

Now, FIG. 4 is a schematic diagram illustrating an exemplary designed landform to be displayed on the display unit 29. As illustrated in FIG. 4, the designed landform is formed by the plurality of designed surfaces 45, each of which is expressed by a triangular polygon. Each of the plurality of designed surfaces 45 indicates the target shape for an object to be excavated by the working unit 2. An operator selects one of the plural designed surfaces 45 as a target designed surface 45A. When the operator excavates the target designed surface 45A with the bucket 8, the working unit controller 26 is configured to move the bucket 8 along an intersected line 47 between the target designed surface 45A and a plane 46 passing through the present position of the cutting edge 8*a* of the bucket 8. It should be noted that in FIG. 4, the reference sign 45 is assigned to only one of the plurality of designed surfaces without being assigned to the others of the plurality of designed surfaces.

Figure 5:
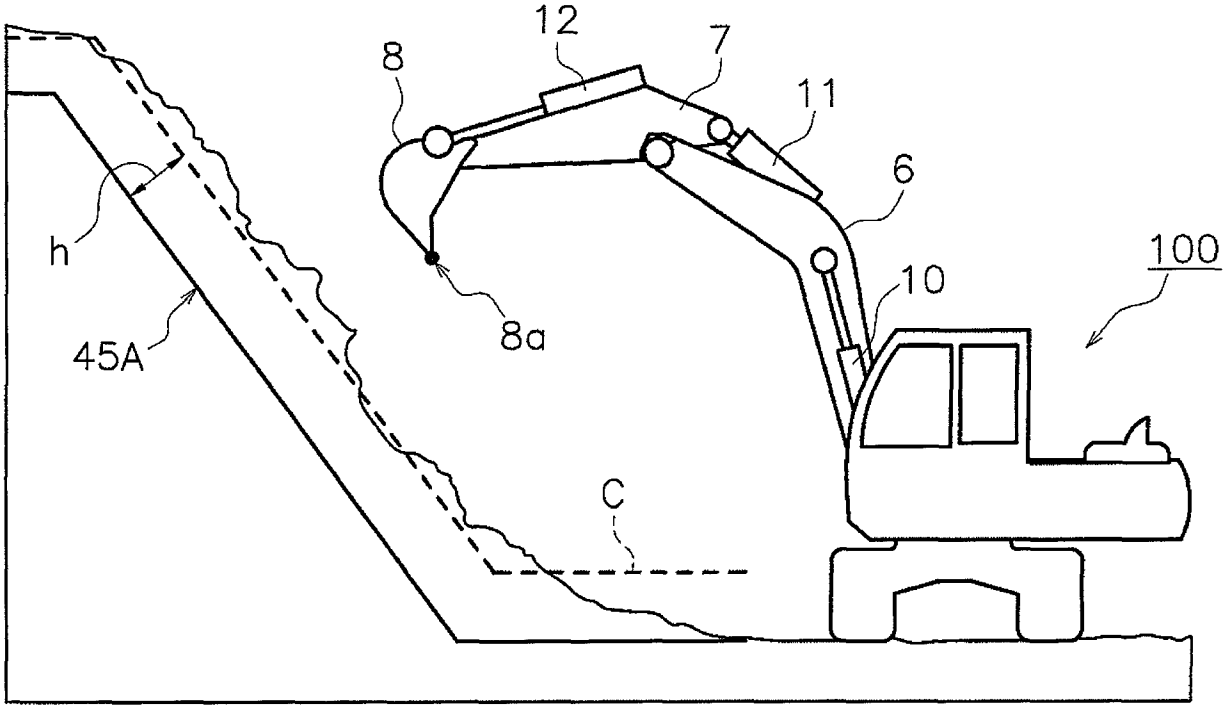
FIG. 5 is a cross-sectional view of the designed landform taken along an intersected line 47.

FIG. 5 is a cross-sectional view of a designed landform taken along the intersected line 47 and is a schematic diagram illustrating an exemplary designed landform to be displayed on the display unit 29. As illustrated in FIG. 5, the designed landform according to the present exemplary embodiment includes the target designed surface 45A and a speed limitation intervening line C.

The target designed surface 45A is a slope positioned laterally to the hydraulic excavator 100. An operator downwardly moves the bucket 8 from above the target designed surface 45A.

The speed limitation intervening line C defines a region in which speed limitation to be described is executed. As described below, when the cutting edge 8*a* enters inside from the speed limitation intervening line C, the excavation control system 200 is configured to execute speed limitation. The speed limitation intervening line C is set to be in a position away from the target designed surface 45A at a line distance h. The line distance h is preferably set to be a distance whereby operational feeding of an operator with respect to the working unit 2 is not deteriorated.

Configuration of Working Unit Controller 26

Figure 6:
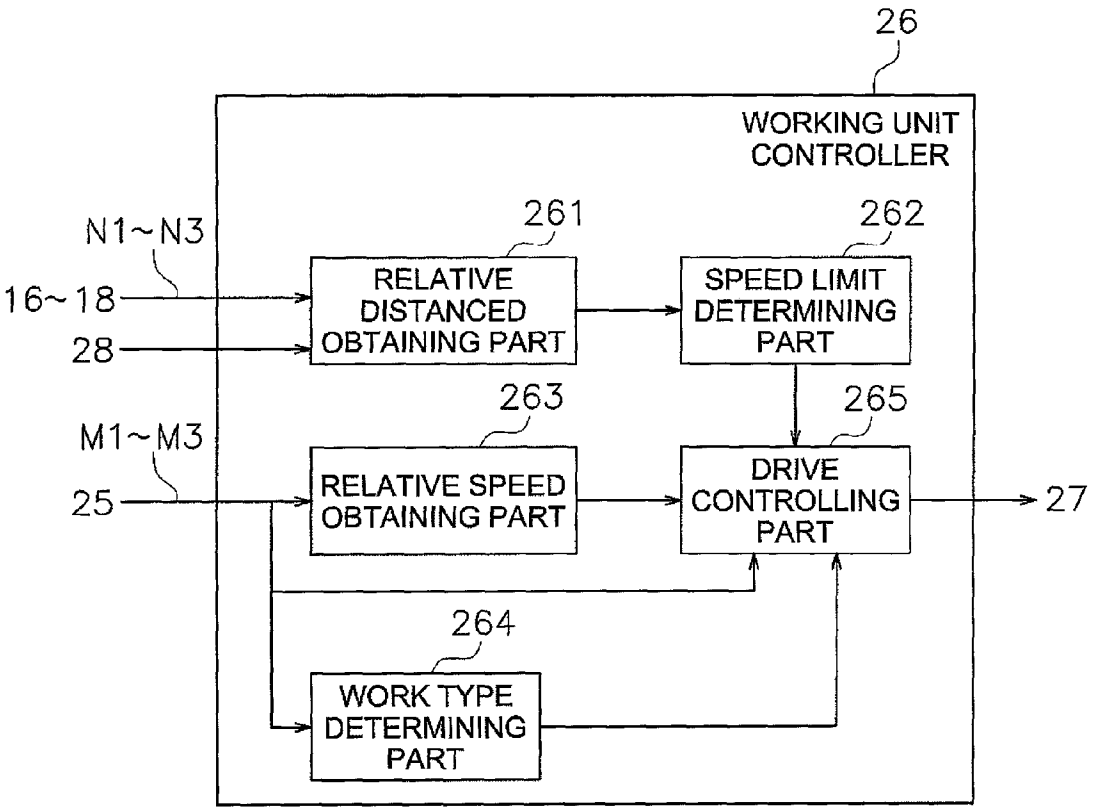
FIG. 6 is a block diagram representing a configuration of a working unit controller 26.
Figure 7:
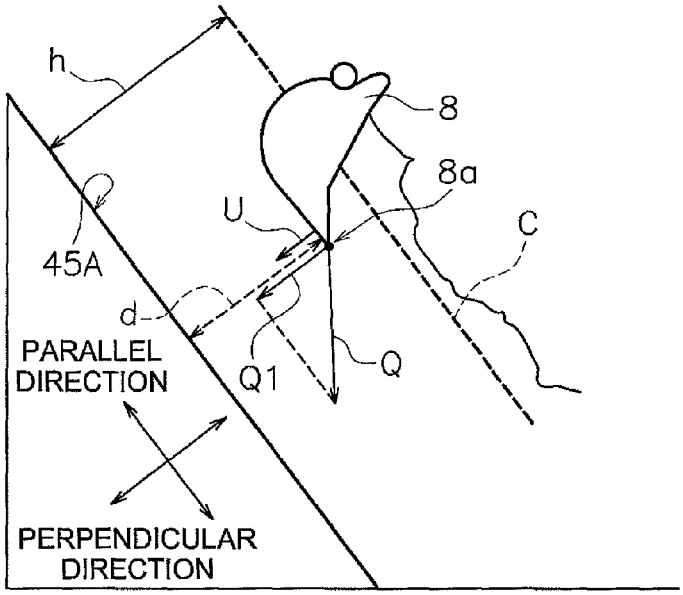
FIG. 7 is a schematic diagram representing a positional relation between a bucket 8 and a first designed surface 451.

FIG. 6 is a block diagram representing a configuration of the working unit controller 26. FIG. 7 is a schematic diagram illustrating a positional relation between the bucket 8 and the target designed surface 45A.

As represented in FIG. 6, the working unit controller 26 includes a relative distance obtaining part 261, a speed limit determining part 262, a relative speed obtaining part 263, a work type determining part 264 and a drive controlling part 265.

As illustrated in FIG. 7, the relative distance obtaining part 261 is configured to obtain a distance d between the cutting edge 8*a* and the target designed surface 45A in a perpendicular direction perpendicular to the target designed surface 45A. The relative distance obtaining part 261 is capable of calculating the distance d based on: the set of designed landform data and the set of present positional data of the hydraulic excavator 100, which are obtained from the display controller 28; and the boom cylinder length N1, the arm cylinder length N2 and the bucket cylinder length N3, which are obtained from the first to third stroke sensors 16 to 18. The relative distance obtaining part 261 is configured to output the distance d to the speed limit determining part 262. It should be noted that in the present exemplary embodiment, the distance d is less than the line distance h, and hence, the cutting edge 8*a* enters inside from the speed limitation intervening line C.

Figure 8:
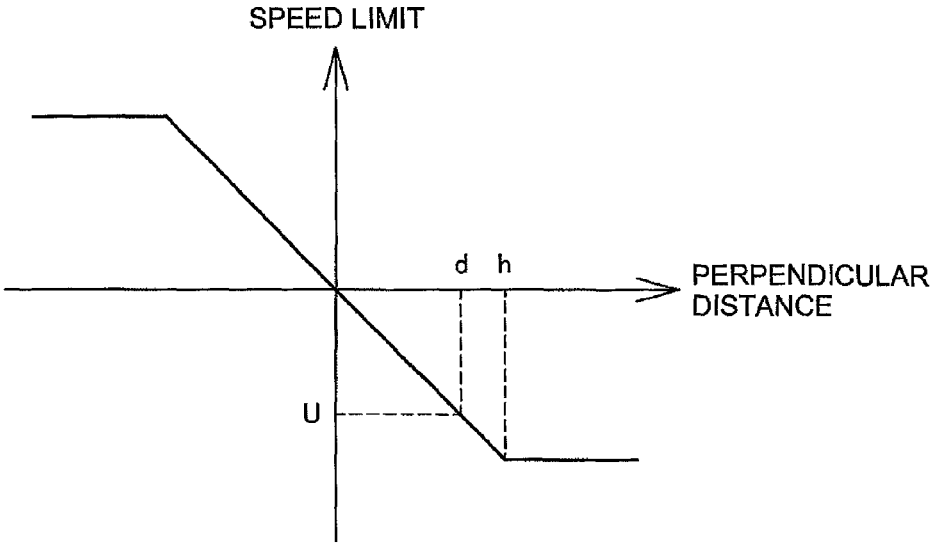
FIG. 8 is a chart representing a relation between a speed limit U and a distance d.

The speed limit determining part 262 is configured to obtain the speed limit U in accordance with the distance d. The speed limit U is a speed set in accordance with the distance d in a uniform manner. As represented in FIG. 8, the speed limit U is maximized where the distance d is greater than or equal to the line distance h, and gets slower as the distance d becomes less than the line distance h. The speed limit determining part 262 is configured to output the speed limit U to the drive controlling part 265. It should be noted that a direction closer to the target designed surface 45A is a negative direction in FIG. 8.

The relative speed obtaining part 263 is configured to calculate a speed Q of the cutting edge 8*a* based on the operation signals M to be obtained from the operating device 25. Further, as illustrated in FIG. 7, the relative speed obtaining part 263 is configured to obtain a relative speed Q1 of the cutting edge 8*a* with respect to the target designed surface 45A based on the speed Q. The relative speed obtaining part 263 is configured to output the relative speed Q1 to the drive controlling part 265. In the present exemplary embodiment, the relative speed Q1 is greater than the speed limit U.

Based on the operation signals M obtained from the operating device 25, the work type determining part 264 is configured to determine to which of a shaping work and a cutting edge aligning work the working unit 2 corresponds.

Here, the shaping work is a type of work for leveling an excavation object along the target designed surface 45A by moving the cutting edge 8*a* along the target designed surface 45A. The shaping work includes, for instance, a slope shaping work for shaping a slope of a cut or that of an embankment. It should be noted that the arm 7 is often driven by an operator in a shaping work.

On the other hand, the cutting edge aligning work is a type of work for setting the cutting edge 8*a* in a position to start the next work by stopping the cutting edge 8*a* in a predetermined position set with reference to the target designed surface 45A. The cutting edge aligning work includes, for instance, setting of the cutting edge 8*a* in the start position for a slope shaping work. The predetermined position can be set to be an arbitrary position on the target designed surface 45A or an arbitrary position away from the target designed surface 45A towards the hydraulic excavator 100. Such predetermined position is adjusted by the value of the perpendicular distance where the speed limit is "0" in the chart of FIG. 8. In the present exemplary embodiment, the value of the perpendicular distance is "0" where the speed limit is "0" as represented in FIG. 8, and therefore, the predetermined position is set on the target designed surface 45A. It should be noted that, when the predetermined position is set in a position away from the target designed surface 45A, it is preferable to set the perpendicular distance to the predetermined position from the target designed surface 45A to be small (i.e., to set the stop position of the cutting edge 8*a* to be adjacent to the target designed surface 45A).

In the present exemplary embodiment, the work type determining part 264 is configured to determine that the work type of the working unit 2 is the shaping work when the operation signals M include an arm operation signal M2 indicating an operation of the arm. On the other hand, the work type determining part 264 is configured to determine that the work type of the working unit 2 is the cutting edge aligning work when the operation signals M do not include the arm operation signal M2 indicating an operation of the arm 7. The work type determining part 264 is configured to inform the drive controlling part 265 of the determination result The drive controlling part 265 is configured to execute speed limitation for limiting the relative speed Q1 of the cutting edge 8*a* with respect to the target designed surface 45A to the speed limit U. In the present exemplary embodiment, the drive controlling part 265 is configured to correct the boom operation signal M1 and is configured to output the corrected boom operation signal M1 to the proportional control valve 27 in order to suppress the relative speed Q1 to the speed limit U only by means of deceleration in rotational speed of the boom 6. Accordingly, the speed of the cutting edge 8*a* in the perpendicular direction gets slower as the cutting edge 8*a* gets closer to the target designed surface 45A, while becoming "0" (see FIG. 8) when the cutting edge 8*a* reaches a predetermined position (a position on the target designed surface 45A in the present exemplary embodiment).

Further, the drive controlling part 265 is configured to move the cutting edge 8*a* along the target designed surface 45A when the work type determining part 264 determines that the work type is the shaping work. Specifically, the drive controlling part 265 is configured to correct the boom operation signal M1 and is configured to output the corrected boom operation signal M1 to the proportional control valve 27 as described above, while being configured to output the arm operation signal M2 and the bucket operation signal M3 to the proportional control valve 27 without correcting the signals M2 and M3. As a result, the working unit 2 is driven and controlled in a shaping mode of moving the cutting edge 8*a* along the target designed surface 45A.

On the other hand, the drive controlling part 265 is configured to stop the cutting edge 8*a* in a predetermined position (a position on the target designed surface 45A in the present exemplary embodiment) set with reference to the target designed surface 45A when the work type determining part 264 determines that the work type is the cutting edge aligning work. Specifically, until the cutting edge 8*a* reaches the target designed surface 45A, the drive controlling part 265 is configured to correct the boom operation signal M1 and is configured to output the corrected boom operation signal M1 to the proportional control valve 27 as described above, while being configured to output the bucket operation signal M3 to the proportional control valve 27 without correcting the signal M3. Then, after the cutting edge 8*a* reaches the target designed surface 45A, the drive controlling part 265 is configured to correct the boom operation signal M1 and the bucket operation signal M3 so that the speed of the cutting edge 8*a* in a parallel direction parallel to the target designed surface 45A becomes "0", and is configured to output the corrected signals M1 and M3 to the proportional control valve 27. As a result, the working unit 2 is driven and controlled in a cutting edge aligning mode of stopping the cutting edge 8*a* in a predetermined position.

It should be noted that, when it is determined that the work type is the cutting edge aligning work, the arm operation signal M2 has not been outputted from the operating device 25. However, when the arm operation signal M2 has been outputted thereafter from the operating device 25, it is determined that the work type is the shaping work. As a result, the driving control of the working unit 2 is transitioned from the cutting edge aligning mode to the shaping mode.

Action of Excavation Control System 200

Figure 9:
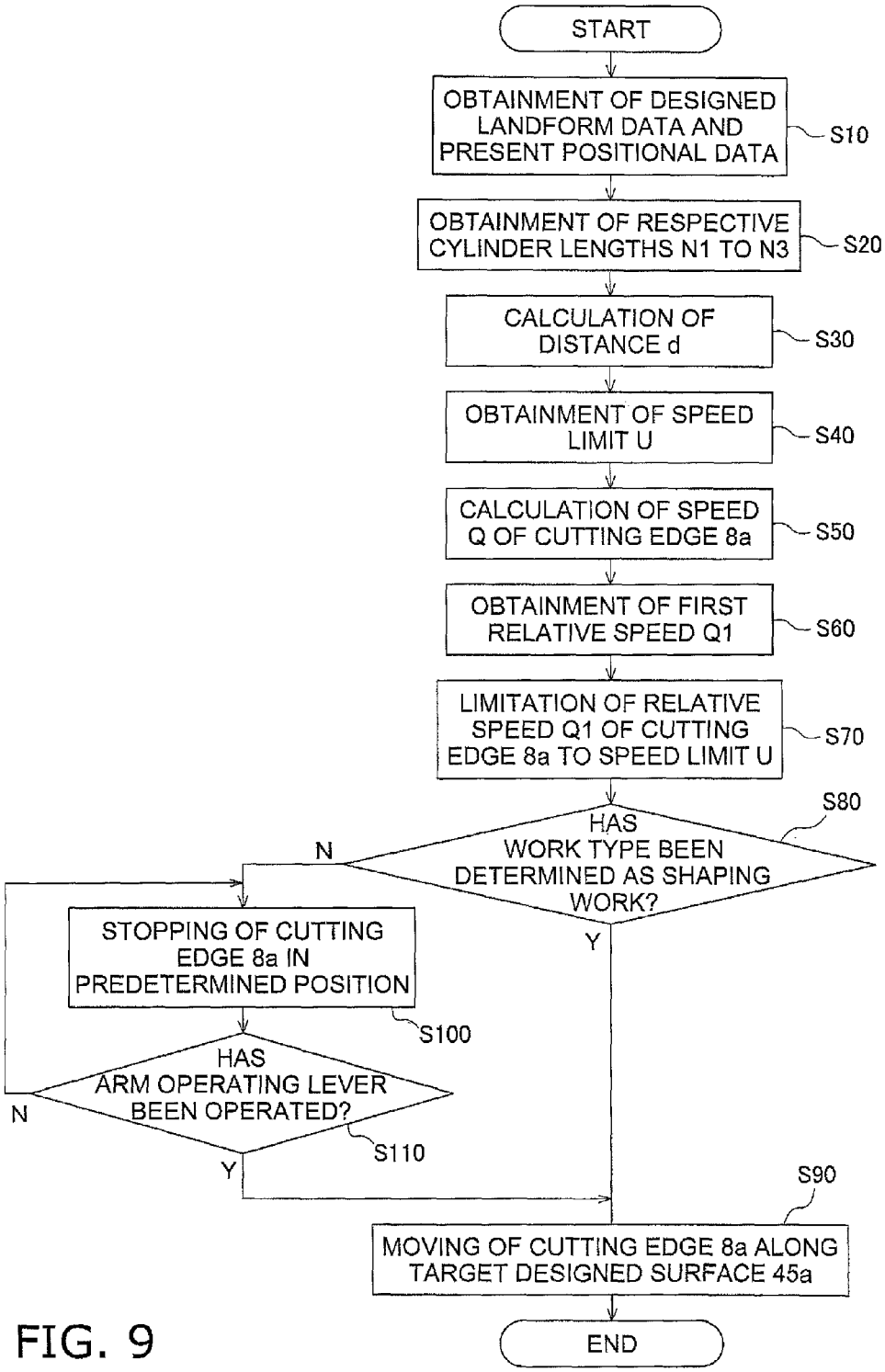
FIG. 9 is a flowchart for explaining an action of the excavation control system 200.

FIG. 9 is a flowchart for explaining an action of the excavation control system 200.

In Step S10, the excavation control system 200 obtains the set of designed landform data and the set of present positional data of the hydraulic excavator 100.

In Step S20, the excavation control system 200 obtains the boom cylinder length N1, the arm cylinder length N2 and the bucket cylinder length N3.

In Step S30, the excavation control system 200 calculates the distance d based on the set of designed landform data, the set of present positional data, the boom cylinder length N1, the arm cylinder length N2 and the bucket cylinder length N3 (see FIG. 7).

In Step S40, the excavation control system 200 obtains the speed limit U depending on the distance d (see FIG. 8).

In Step S50, the excavation control system 200 calculates the speed Q of the cutting edge 8*a* based on the boom operation signal M1, the arm operation signal M2 and the bucket operation signal M3 (see FIG. 7).

In Step S60, the excavation control system 200 obtains the relative speed Q1 based on the speed Q (see FIG. 7).

In Step S70, the excavation control system 200 suppresses the relative speed Q1 to the speed limit U only by means of deceleration in rotational speed of the boom 6 (see FIG. 7).

In Step S80, the excavation control system 200 determines whether or not the work type of the working unit 2 is the shaping work based on the operation signals M. Specifically, the excavation control system 200 determines that the work type of the working unit 2 is the shaping work when the operation signals M include the arm operation signal M2 indicating an arm operation, whereas determining that the work type of the working unit 2 is the cutting edge aligning work when the operation signals M do not include the arm operation signal M2. When the work type is the shaping work, the processing proceeds to Step S90. When the work type is not the shaping work, it is determined that the work type is the cutting edge aligning work, and the processing proceeds to Step S100.

In Step S90, the excavation control system 200 moves the cutting edge 8*a* along the target designed surface 45A. Specifically, as described above, the excavation control system 200 corrects the boom operation signal M1 and outputs the corrected boom operation signal M1 to the proportional control valve 27, while outputting the arm operation signal M2 and the bucket operation signal M3 to the proportional control valve 27 without correcting the signals M2 and M3.

In Step S100, the excavation control system 200 stops the cutting edge 8*a* in a predetermined position (an arbitrary position on the target designed surface 45A in the present exemplary embodiment) set with reference to the target designed surface 45A. Specifically, as described above, the drive controlling part 265 corrects the boom operation signal M1 and outputs the corrected boom operation signal M1 to the proportional control valve 27, while outputting the bucket operation signal M3 to the proportional control valve 27 without correcting the signal M3.

In Step S110, the excavation control system 200 determines whether or not an operator has operated the arm operating lever 32*a*, in other words, whether or not the operating device 25 has outputted the arm operation signal M2. When it is determined that the operator has operated the arm operating lever 32*a*, the processing proceeds to Step S90. When it is determined that the operator has not operated the arm operating lever 32*a*, the processing returns to Step S100.

Actions and Effects (1) The excavation control system 200 according to the present exemplary embodiment includes the work type determining part 264 and the drive controlling part 265. Based on the operation signals M, the work type determining part 264 is configured to determine to which of the shaping work and the cutting edge position aligning work the working unit 2 corresponds. The drive controlling part 265 is configured to move the cutting edge 8*a* of the bucket 8 along the target designed surface 45A when it is determined that the work type is the shaping work. The drive controlling part 265 is configured to stop the cutting edge 8*a* of the bucket 8 in a predetermined position set with reference to the target designed surface 45A when it is determined that the work type is the cutting edge aligning work.

Therefore, the cutting edge 8*a* can be moved along the target designed surface 45A independently from an operation by an operator during execution of the shaping work, whereas the cutting edge 8*a* can be stopped in a predetermined position in response to an operation by the operator during execution of the cutting edge aligning work. Therefore, it is possible to inhibit occurrence of a situation that the cutting edge 8*a* is inevitably moved along the target designed surface 45A in spite of intension of executing the cutting edge aligning work. Thus, the excavation control system 200 according to the present exemplary embodiment can automatically switch the drive control of the working unit 2 between the shaping mode and the cutting edge aligning mode.

(2) The excavation control system 200 according to the present exemplary embodiment is configured to execute speed limitation by regulating the extension/contraction speed of the boom cylinder 10.

Therefore, speed limitation is executed by correcting only the boom operation signal M1 among the operation signals in response to operations by an operator. In other words, among the boom 6, the arm 7 and the bucket 8, only the boom 6 is not driven as operated by an operator. Therefore, it is herein possible to inhibit deterioration of operational feeling of an operator in comparison with the configuration of regulating the extension/contraction speeds of two or more driven members among the boom 6, the arm 7 and the bucket 8.

(3) In the excavation control system 200 according to the present exemplary embodiment, the work type determining part 264 is configured to determine that the work type is the shaping work when the operation signals M include the arm operation signal M2 indicating an operation of the arm 7.

Now, it is known that an operator often drives the arm 7 in executing the shaping work. Therefore, such determination can be executed easily, conveniently and accurately based on existence/non-existence of the arm operation signal M2.

(4) The excavation control system 200 according to the present exemplary embodiment is configured to: execute speed limitation by regulating the extension/contraction speed of the boom cylinder 10; and determine the work type based on existence/non-existence of the arm operation signal M2. Therefore, operator's intension of executing or not executing excavation can be determined, while speed limiting intervention can be executed. In other words, the cutting edge can be aligned in accordance with the operational intension of an operator, when being aligned in switching of an excavation surface from a slope top surface to a slope face or in starting excavation. Thus, work efficiency can be enhanced.

Other Exemplary Embodiments

An exemplary embodiment of the present invention has been explained above. However, the present invention is not limited to the aforementioned exemplary embodiment, and a variety of changes can be made without departing from the scope of the present invention.

(A) In the aforementioned exemplary embodiment, the work type determining part 264 is configured to determine the work type of the working unit 2 based on the operation signals M. However, the present invention is not limited to this.

For example, the work type determining part 264 can determine the work type of the working unit 2 based on at least one of the inside pressures in the cylinders of the boom cylinder 10, the arm cylinder 11 and the bucket cylinder 12. This is a method using the fact that the inside pressure of a cylinder is temporarily increased in response to increase in supply amount of the operating oil when a shaping work is executed. In the method, the work type determining part 264 is configured to obtain at least one inside pressure from an inside pressure obtaining part that is configured to obtain the inside pressures. The work type determining part 264 can determine that the work type is the shaping work when the inside pressure is greater than or equal to a predetermined value, and on the other hand, can determine that the work type is the cutting edge aligning work when the inside pressure is less than the predetermined value.

Further, the excavation control system 200 can determine the work type of the working unit 2 based on the discharge pressure of the hydraulic pump for supplying the operating oil to the proportional control valve 27. This is a method using the fact that the amount of operating oil to be discharged from the hydraulic pump is temporarily increased when a shaping work is executed. In the method, the work type determining part 264 is configured to obtain the discharge pressure from a discharge pressure obtaining part that is configured to obtain the discharge pressure. The work type determining part 264 can determine that the work type is the shaping work when the discharge pressure is greater than or equal to a predetermined value, and on the other hand, can determine that the work type is the cutting edge aligning work when the discharge pressure is less than the predetermined value.

(B) In the aforementioned exemplary embodiment, the work type determining part 264 is configured to determine the work type of the working unit 2 based on whether or not the operation signals M include the arm operation signal M2. However, the present invention is not limited to this.

For example, the work type determining part 264 may be configured to determine the work type of the working unit 2 based on whether or not the operation signals M include two or more signals, including the arm operation signal M2, among the boom operation signal M1, the arm operation signal M2 and the bucket operation signal M3.

(C) In the aforementioned exemplary embodiment, the working unit controller 26 is configured to execute speed limitation based on the position of the cutting edge 8*a* among portions of the bucket 8. However, the present invention is not limited to this. The working unit controller 26 can execute speed limitation based on an arbitrary position on the bucket 8.

(D) In the aforementioned exemplary embodiment, a predetermined position in which the cutting edge 8*a* is stopped is set on the target designed surface 45A. However, the present invention is not limited to this. The predetermined position may be set in an arbitrary position separated away from the target designed surface 45A towards the hydraulic excavator 100. In this case, a value of the perpendicular distance, where the speed limit is "0" in the chart of FIG. 8, corresponds to an interval between the target designed surface 45A and the predetermined position.

(E) In the aforementioned exemplary embodiment, the excavation control system 200 is configured to suppress the relative speed to the speed limit only by deceleration of the rotational speed of the boom 6. However, the present invention is not limited to this. The excavation control system 200 may be configured to regulate the rotational speed of at least one of the arm 7 and the bucket 8 in addition to the rotational speed of the boom 6. It is thereby possible to inhibit the speed of the bucket 8 from being reduced in a direction parallel to the designed surface 45 by means of speed limitation. Accordingly, it is possible to inhibit deterioration of operational feeling of an operator.

(F) In the aforementioned exemplary embodiment, the excavation control system 200 is configured to calculate the speed Q of the cutting edge 8*a* based on the operation signals M to be obtained from the operating device 25. However, the present invention is not limited to this. The excavation control system 200 can calculate the speed Q based on variation per unit time for each of the cylinder lengths N1 to N3 to be obtained from the first to third stroke sensors 16 to 18. In this case, the speed Q can be more accurately calculated compared to a configuration of calculating the speed Q based on the operation signals M.

(G) In the aforementioned exemplary embodiment, as represented in FIG. 8, a linear relation is established between the speed limit and the perpendicular distance. However, the present invention is not limited to this. An arbitrary relation may be established between the speed limit and the perpendicular distance. Such relation is not necessarily a linear relation, and its relational curve is not required to pass through the origin of its relevant chart.

According to the illustrated embodiments, it is possible to provide a working unit control system capable of automatically switching between a shaping mode and a cutting edge aligning mode. Therefore, the working unit control system and method according to the illustrated embodiments is useful for the field of construction machines.

What is claimed is:

1. A working unit control system comprising:

a working unit including a boom rotatably attached to a vehicle main body, an arm rotatably attached to the boom, and a bucket rotatably attached to the arm;

an operating tool configured to receive a user operation to drive the working unit, the operating tool being configured to output an operation signal in accordance with the user operation, the operating tool including an arm operating lever configured to receive the user operation to drive the arm;

a work type determining part configured to determine that a work type of the working unit corresponds to a shaping work when an arm operation signal outputted in response to an operation of the arm operating lever for operating the arm is included in the operation signal, the work type determining part configured to determine that the work type of the working unit corresponds to a cutting edge aligning work when the arm operation signal is not included in the operation signal; and a drive controlling part configured to operate the working unit in a shaping mode when the work type determining part determines that the work type corresponds to the shaping work and operate the working unit in a cutting edge aligning mode when the work type determining part determines that the work type corresponds to the cutting edge aligning work, the drive controlling part being configured to automatically move the bucket along a designed surface when the working unit is operated in the shaping mode, the drive controlling part being configured to automatically stop the bucket in a predetermined position set with reference to the designed surface when the working unit is operated in the cutting edge aligning mode, the designed surface indicating a target shape of an excavation object.

2. The working unit control system recited in claim 1, further comprising:

a boom cylinder for driving the boom; and a speed limit determining part configured to determine a speed limit of the bucket with respect to the designed surface based on a distance between the designed surface and the bucket, wherein the drive controlling part is configured to limit the relative speed to the speed limit when the bucket is positioned within a predetermined distance from the designed surface.

3. The working unit control system recited in claim 2, wherein the drive controlling part is configured to limit the relative speed to the speed limit by regulating an extension/contraction speed of the boom cylinder.

4. A construction machine comprising:

the vehicle main body; and the working unit control system recited in claim 2.

5. A construction machine comprising:

the vehicle main body; and the working unit control system recited in claim 3.

6. A construction machine comprising:

the vehicle main body; and the working unit control system recited in claim 1.

7. A working unit control method comprising:

receiving a user operation to drive a working unit and outputting an operation signal in accordance with the user operation, the working unit being formed by a plurality of driven members, the driven members of the working unit including a boom rotatably attached to a vehicle main body, an arm rotatably attached to the boom, and a bucket rotatably attached to the arm;

determining that a work type of the working unit corresponds to a shaping work when an arm operation signal for operating the arm is included in the operation signal, and determining that the work type of the working unit corresponds to a cutting edge aligning work when the arm operation signal is not included in the operation signal;

operating the working unit in a cutting edge aligning mode in which the bucket is automatically stopped in a predetermined position set with reference to a designed surface indicating a target shape of an excavation object when it is determined that the work type corresponds to the cutting edge aligning work; and operating the working unit in a shaping mode in which the bucket is automatically moved along the designed surface when it is determined that the work type corresponds to the shaping work.

* * * * *